United States Patent [19]

Pipasik

[11] Patent Number: 4,729,562

[45] Date of Patent: Mar. 8, 1988

[54] TOTAL ABDOMINAL WORKOUT MACHINE

[76] Inventor: George Pipasik, 954 14th St., Apt. A, Santa Monica, Calif. 90403

[21] Appl. No.: 921,535

[22] Filed: Oct. 22, 1986

[51] Int. Cl.[4] ..... A63B 21/06

[52] U.S. Cl. ..... 272/117; 272/134

[58] Field of Search ..... 272/134, 143, 144, 145, 272/117; 128/68, 70–74

[56] References Cited

U.S. PATENT DOCUMENTS

| | | | |
|---|---|---|---|
| 1,539,214 | 5/1925 | Shockey | 272/144 |
| 2,152,431 | 3/1939 | Jensan | 128/74 |
| 4,372,553 | 2/1983 | Hatfield | 272/134 X |
| 4,405,128 | 9/1983 | McLaughlin et al. | 272/117 |

FOREIGN PATENT DOCUMENTS

| | | | |
|---|---|---|---|
| 3343634 | 6/1985 | Fed. Rep. of Germany | 272/143 |

*Primary Examiner*—Richard J. Apley
*Assistant Examiner*—J. Welsh
*Attorney, Agent, or Firm*—Philip D. Junkins

[57] ABSTRACT

An exercise machine for exercising the total abdominal zone and muscles of an exercising person. The machine's chassis is comprised of base members and upwardly extending members which support a downwardly arcuate seating member for the exercising person. Back support apparatus is provided which includes a frame rotatably attached to the rear end of the seating member, a back rest slidably affixed within the central area of the frame, a pair of handles extending from the top of the frame and weights which are movably affixed to the rear of the frame for adjusting the amount of lever force required to be applied by the exercising person to the handles to move the back support forwardly during exercise use of the machine. The machine also includes leg support apparatus consisting of an extensible tubing arrangement attached at its rearward end to the front end of the arcuate seating member, and pedals attached to the forward end of the tubing arrangement for receiving and supporting the feet of the exercising person.

The exercise machine is operable so that abdominal muscles are exercised by: (a) movement only of the arms and upper torso of the exercising person through levered rotation of the back support apparatus through pulling action of the arms (the leg support apparatus being maintained stationary); (b) movement only of the leg support apparatus through levered rotation of the leg support apparatus (the back support apparatus being maintained stationary); and (c) rotative movement together of the back support apparatus and the leg support apparatus.

10 Claims, 3 Drawing Figures

TOTAL ABDOMINAL WORKOUT MACHINE

BACKGROUND

The prevailing health-conscious trend commands the development of an ever increasing equipment variety for the exercising of the human body and of discrete parts thereof, covered by the term "workout". The subject concept extends especially to the workout of the abdominal part. It should, however, be noted that this equipment, like most others of this genre, may lend itself also to rehabilitation, educational and training applications.

The applicant became aware of the need for such a machine providing the workout capabilities, primarily for the abdominal part of the human body, through his long experience in both the building and the application of machines used in gymnasiums. Based on this background, it appeared that, although the general workout machines may have a limited beneficial effect on the abdominal part, they do not and can not exercise the abdominal part in the required thorough and adequate manner.

SUMMARY OF INVENTION

This invention extends to a total and highly specialized abdominal workout machine having the following major characteristics:

(a) It places the exercising person in the optimum position for abdominal workout.

(b) It allows for the abdominal workout with the person's legs stationary and his/her back rocking back and forth.

(c) Conversely, it allows for the abdominal workout with the person's back stationary and his/her legs bending and stretching, respectively.

(d) It allows for the abdominal workout with a person's simultaneous actuation of his/her legs and back.

(e) It allows for the adjustment of the forces opposing a person's workout movements through slidable counterweights.

(f) It provides for "negative" workout through the application of mechanical springs arranged so as to oppose a person's relaxed state.

(g) The movable extremities of the machine can, when not in use, be tilted upwardly, thereby occupying a minimum of floor space and facilitating the traffic in and the cleaning of the surrounding gymnasium area.

Further advantages of the subject improvement—per se—and over prior art will become more apparent from the following description and the accompanying drawing.

In the drawing, forming a part of this application:

DETAILED DESCRIPTION

Figure 1:
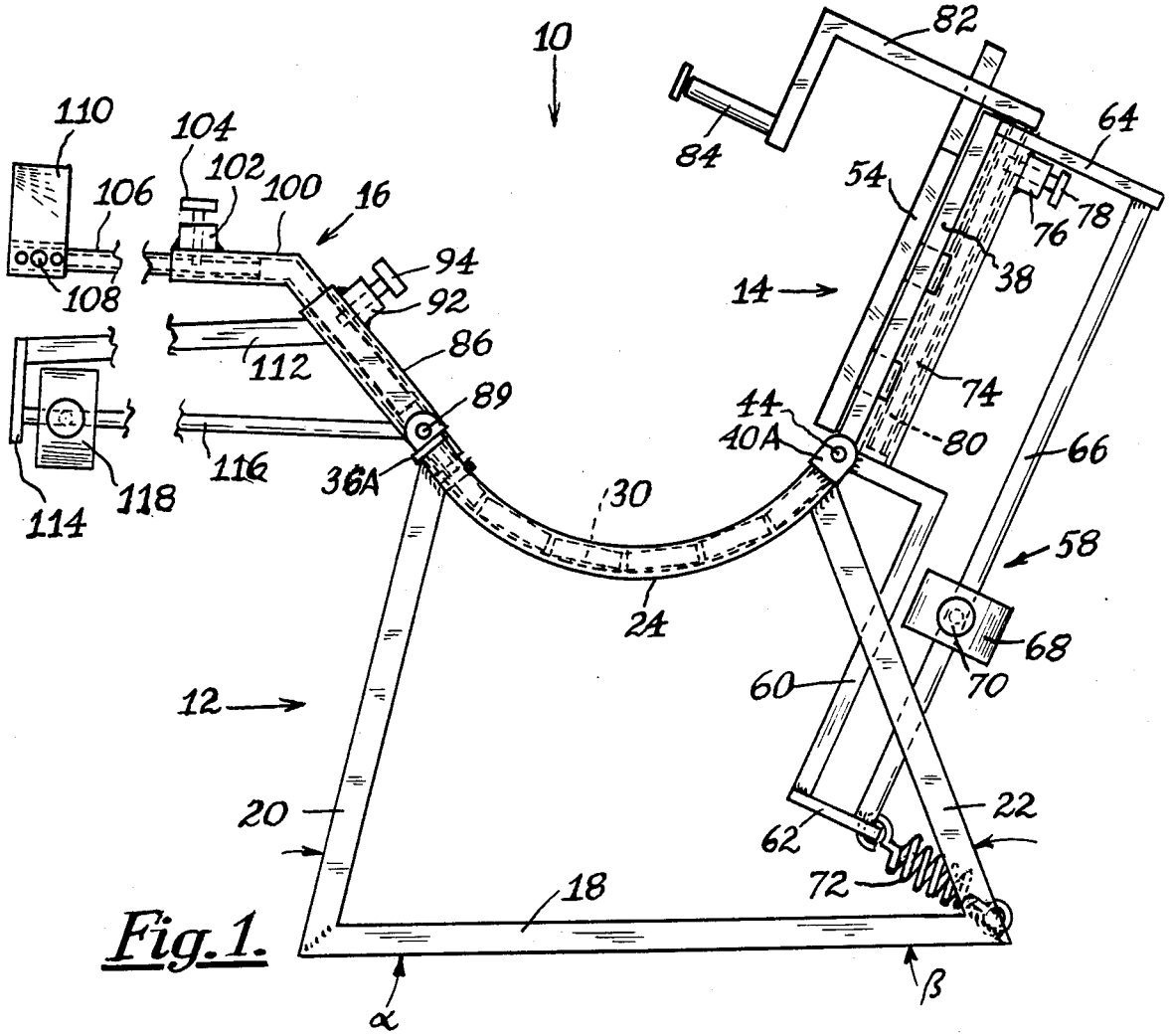
FIG. 1 is a front elevation of the subject machine.

Referring now to the drawing, wherein like reference numerals designate like or corresponding parts and, more particularly, to FIG. 1, the typical entire total abdominal workout machine 10 consists essentially of a chassis 12, a back support 14 and a leg support 16.

Figure 2:
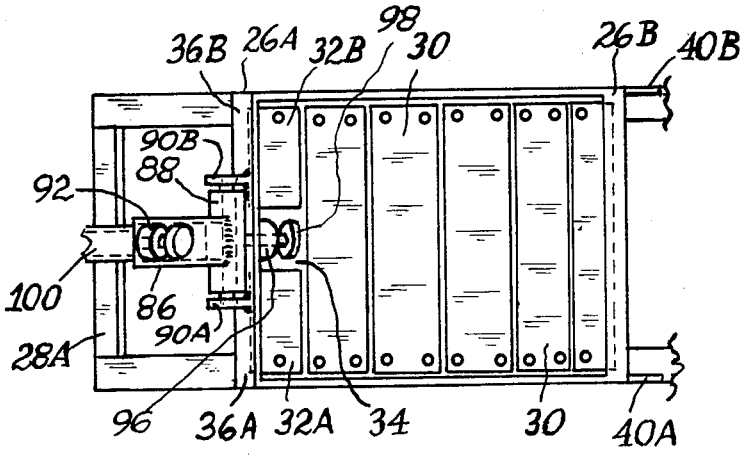
FIG. 2 is a plan view of the seating area of the machine and of the means for its connection with coacting component parts and FIG. 3 is a rear view of the backrest of the workout machine.

The chassis 12 is composed of a horizonally positioned base member 18, a front member 20 positioned upwardly and in an acute angle $\alpha$ with respect to said base member 18, a rear member 22 positioned upwardly and in an acute angle $\beta$ with respect to said base member 18 and a downwardly arcuate member 24 fastened between the upper ends of the front member 20 and the rear member 22, respectively. The foregoing component parts enumeration applies for the corresponding structure behind (far side) that shown in FIG. 1 for the chassis 12, assembled to the front structure by means of members 26A and 26B at the chassis top and the members 28A and 28B (the latter not shown) at the chassis bottom. The members 18, 20 and 22 are structural shapes of any suitable cross-sectional geometry, whereas the arcuate members 24 are equal angles facing upwardly and at each other, thereby forming a support for, in this example, five boards 30 positioned between the vertical webs and secured, to the horizontal webs of said angles of said arcuate members 24, constituting the area upon which a person is seated. The, in this case, extreme left space is occupied by two boards 32A and 32B leaving a space 34 between them. Additional boards 36A and 36B are mounted on and at the near and far end of the chassis members 26A and 26B, respectively, serving as supports for the back of a person's knees. This detail is also shown in the plan view, FIG. 2. While the aforememtioned boards are made of wood, other materials having comparable properties may be employed.

Having described the composition of the chassis 12 the salient and believed to be novel feature of the subject invention become apparent, deserving special mention: Through both field tests and actual operation of the machine it was determined that the elevation above the floor of the end of the arcuate members 24 at the back support 14 shall be 3.5 inches below the opposite end of the arcuate member 24 at the leg support 16, plus or minus the conventional manufacturing tolerances, to provide optimum performance.

Figure 3:
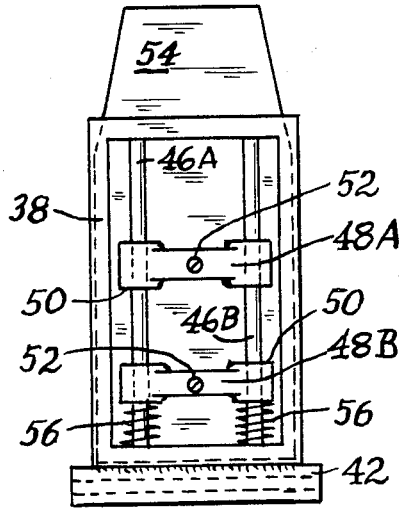

Turning now to the description of the back support 14, it consists of a rectangularly-shaped frame 38 made of structural shapes of suitable cross-sectional geometry and material attached at its shorter and horizontal side to a sleeve 42 (shown in FIG. 3). Ears 40A and 40B, each having a hole formed in it, are mounted on the spacer 26B and spaced apart from each other so as to accommodate said sleeve 42 of said rectangularly shaped frame 38 by means of a pin 44, the latter being secured within said ears 40A and 40B allowing for its rotation about said pin 44. Two round bars 46A and 46B are mounted inside of and parallel with the longer sides of said frame 38 and spaced apart from each other and from each said longer frame side. Two brackets 48A and 48B each having two ends and a vertical sleeve 50 formed at each of its ends and a horizontal hole 52 formed at a location between each said two vertical sleeves 50 are provided to accommodate the backrest 54 of the back support 14 by means of, say, the binding screws 52. A mechanical compression spring 56 is positioned about and at the bottom of each said round steel bar 46A and 46B, respectively. The position of the bracket 48B is such as to cause the contact with and the compression of said springs 56 when the backrest 54 is in its inactive state, thereby utilizing the cushioning effect of the springs to avoid any harmful impact. Conversely, the upper bracket 48A is located at a distance from the upper horizontal side of the rectangular frame 38 so as to allow the sliding of the back rest 54 in an upward direction caused by the pressure of a person's back leaning against it during the abdominal workout.

The rear of the back support 14 is equipped with a counterweight arrangement 58 consisting of a pair of downwardly facing angles 60 mounted, spaced apart from each other, on said sleeve 42, a plate 62 mounted at the bottom of both said angles 60 facing rearwardly, a substantially U-shaped bracket 64 mounted horizontally and facing rearwardly on the top side of said frame 38 and a pair of round bars 66 mounted parallel to and spaced apart from each other between said plate 62 and said bracket 64. A cylindrical weight 68 having an axial through hole (not shown) formed in its interior of a diameter to accommodate a said round bar 66 and a radial, tapped hole (not shown) formed to accommodate a set screw 70 is placed about each said round bar 66, thereby providing the desired adjustment of the, in this example, positive force opposing that exerted by the exercising person. Should a negative opposing force be required or desired, a mechanical expansion spring 72 is mounted with one of its two ends in a hole formed (not shown) in the center of said plate 62 and with its other end in a hole formed (not shown) in the member 28B (not shown).

An, in this case, square tubing 74 is mounted on the back of said frame 38 having a hole (not shown) formed near the top of the flat back side. A boss 76 is mounted at the top of said flat back side having a threaded axial hole (not shown) formed in its interior, concentric with the aforementioned hole, and accommodating a set screw 78.

Another, in this case likewise square tubing 80 is placed slidably within said tubing 74 having a plurality of holes (not shown) formed sequentially on the lower side and spaced apart from each other in discrete distances to allow for the mating of one of these holes with said set screw 78. An angularly offset U-shaped member 82 is mounted on the top of said square tubing 80 at the opposite ends of which two handles 84 are mounted spaced apart from each other (in depth when viewed in FIG. 1) to permit the placing of a person's head and his/her fist halves between them.

It may be in order to insert at this place that the expression "mounted", used throughout this disclosure may connote "by means of welding, riveting, brazing and by bolt and screw attachment", selectively.

It should also be noted that the expressions of orientation such as "up", "down", "left" and "right" "front" and "back" refer to both the views in the drawing and to the actual machine positioning and its parts relations.

Referring now to the leg support 16, an, in this example, square tubing 86 is mounted at one of its two ends to a sleeve 88, which is secured, rotatable, about the pin 89, the latter being installed within and across said ears 90A and 90B.

A boss 92 having a tapped axial hole is mounted at the other end of the square tubing 86 and a set screw 94 is inserted into said boss 92. Another boss 96 is mounted on the member 26A and has a tapped axial hole formed in it to accommodate a set screw 98, capable of arresting the leg support structure 16 in any desired angular position. Ears 90A and 90B are mounted on the member 26 and spaced apart from each other to accept said sleeve 88 with said square tubing 86 positioning its axis of symmetry with that of the entire machine 10.

A downwardly-open, elbow-shaped square tubing 100 is inserted slidably within said square tubing 86; it has a plurality of holes (not shown) spaced apart from each other sequentially formed in its upper side portion which is inserted into said square tubing 86 to be arrested by said set screw 94 when engaging the suitable hole in the square tube's 100 upper side portion. A boss 102 is mounted on the top flat and at the free end of said elbow-shaped square tubing 100 having a tapped axial hole (not shown) formed therein to accept a set screw 104.

A further square tubing 106, having a plurality of holes (not shown) formed on its upper side spaced apart from each other sequentially, is inserted into said tubing 100 with one of its two ends to be arrested at any desired extension with said set screw 102. An axle 108 is installed at the other end of said tubing 106 extending horizontally and perpendicularly with respect to said tubing 100. A pedal 110 is mounted rotatably on each extension of said axle 108 for the insertion of a person's feet.

The leg support 16 can be made rotatable about the pin 89 by loosening the set screw 98. When in this condition, the availability of counterweights may be desired or required. To accomplish this, a member 112 is mounted with one of its two ends to the top of said square tubing 86 to extend with its other end and terminating in a downwardly facing plate 114. A round bar 116 is mounted at one of its two ends to said sleeve 88 and with its other end to said plate 114, whereby a counterweight 118 is installed on said round bar prior to its assembly with the leg support. The dimensions and other properties of the counterweight 118 are identical with the previously mentioned ones, obviating any further explanations.

The operation of the herein described abdominal workout machine is basically as follows: The person who is to exercise the abdominal zone and muscles is seated upon the seating area formed by the downwardly arcuate member 24, leaning against said backrest 54 and positioning the feet within the pedals 110 like for riding a bicycle. It is understood that all adjustments to match the person's measurements as well as the counterweight position selections were made previously either to the person's choice or to a physician's instructions.

The various workout modes were enumerated in the "SUMMARY OF INVENTION" chapter under the headings (b), (c), (d), (e) and (f), obviating a reiteration.

It is understood that the herein shown and described embodiment of the subject invention is but illustrative and that variations, modifications and alterations are feasible within the spirit of these teachings.

I claim:

1. An exercise machine for exercising the total abdominal zone and muscles of an exercising person, comprising:

(a) a chasis consisting of base members, front members extending upwardly from said base members, rear members extending upwardly from said base members, and a downwardly arcuate seating member affixed at its front end to the upper ends of said front members and affixed at its rear end to the upper ends of said rear members for supporting an exercising person in a seated position, the front end of said arcuate seating member being elevated with respect to the rear end of said arcuate seating member;

(b) a back support consisting of a frame rotatably attached to the rear end of said arcuate seating member, a back rest slidably affixed within the central area of said frame for supporting the back of the exercising person, a pair of handles extending from the upper end of said frame and positioned for grasping engagement by the hands of the exercising person, and weight means movably affixed to the rear of said frame for adjusting the amount of lever force required to be applied by the arms and hands of the exercising person to said handles to move said frame, with said back rest and weight means, forwardly about its axis of rotatably attachment to said arcuate seating member and thereby provide abdominal workout exercise of said person; and (c) leg support means consisting of an extensible tubing arrangement attached at its rearward end to the front end of said arcuate seating member, and pedal attached to the forward end of said tubing arrangement for receiving and supporting hte feet of the exercising person.

2. An exercise machine for exercising the total abdominal zone and muscles of an exercising person as claimed in claim 1 wherein the weight means movably affixed to the rear of the back support frame is positionable above and below the axis of rotatable attachment of said frame to said arcuate member.

3. An exercise machine for exercising the total abdominal zone and muscles of an exercising person as claimed in claim 1 wherein the weight means movably affixed to the rear of the back support frame is comprised of one or more elongated bars positioned parallel to and supported by said frame and a weight unit slidably mounted to each of said bars, said one or more bars extending upwardly to a point proximate the upper end of said frame and extending downwardly to a point below the lower end of said frame whereby the weight unit mounted to said one or more bars is positionable above and below the axis of rotatable attachment of said frame to said arcuate seating member.

4. An exercise machine for exercising the total abdominal zone and muscles of an exercising person as claimed in claim 3 wherein the lower end of said weight means is spring biased to said base members to counter the lever force of said weight means.

5. An exercise machine for exercising the total abdominal zone and muscles of an exercising person as claimed in claim 1 wherein the pair of handles extending from the upper end of the back support frame are affixed to telescoping support means mounted to said frame whereby said handles may be positioned at a variable distance above the upper end of said back support.

6. An exercise machine for exercising the total abdominal zone and muscles of an exercising person as claimed in claim 1 wherein the pair of handles extending from the upper end of the back support frame are spaced apart a distance whereby upon any downward movement of said handles they straddle the head of said person.

7. An exercise machine for exercising the total abdominal zone and muscles of an exercising person as claimed in claim 1 wherein the leg support means is rotatably attached at its rearward end to the front end of said arcuate seating member and has associated therewith weight means movably affixed to said extensible tubing arrangement of said support means, for adjusting the amount of lever force required to be applied by the legs and feet of the exercising person to said pedals to move said leg support means upwardly about its axis of rotatable attachment to said arcuate seating member and thereby provide abdominal workout exercise of said person.

8. An exercise machine for exercising the total abdominal zone and muscles of an exercising person as claimed in claim 7 wherein the weight means movably affixed to the extensible tubing arrangement of the leg support menas is comprised of an elongated bar positioned generally parallel to said tubing arrangement and a weight unit slidably mounted to said bar.

9. An exercise machine for exercising the total abdominal zone and muscles of an exercising person as claimed in claim 1 wherein the back support frame rotatably attached to the rear end of said arcuate seating member may be maintained in a stationary position and the leg support means is rotatably attached at its rearward end to the front end of said arcuate seating member.

10. An exercise machine for exercising the total abdominal zone and muscles of an exercising person as claimed in claim 1 wherein the back rest slidably affixed within the central area of the frame of the back support of said exercise machine is mounted on brackets slidable upwardly and downwardly on bars mounted vertically inside said frame, the lower of said brackets being cushioned in any downward movement thereof on said bars by compression springs surrounding said bars at their lower ends within said frame whereby harmful impact to the back of the exercising person during any movement thereof with said back rest is avoidable.

* * * * *